US006963022B2

(12) United States Patent
Okuno

(10) Patent No.: US 6,963,022 B2
(45) Date of Patent: Nov. 8, 2005

(54) DRUM AND HEAD DIAPHRAGM ADJUSTOR FOR DRUM

(75) Inventor: Kuniaki Okuno, Seto (JP)

(73) Assignee: Hoshino Gakki Mfg. Co., Ltd., (JP)

( * ) Notice: Subject to any disclaimer, the term of this patent is extended or adjusted under 35 U.S.C. 154(b) by 0 days.

(21) Appl. No.: 10/850,634

(22) Filed: May 20, 2004

(65) Prior Publication Data

US 2005/0145091 A1 Jul. 7, 2005

(30) Foreign Application Priority Data

Dec. 24, 2003 (JP) ..... 2003-428391

(51) Int. Cl.[7] ..... G10D 13/02
(52) U.S. Cl. ..... 84/413; 84/411 R
(58) Field of Search ..... 84/411 R, 41 B, 84/420, 421

(56) References Cited

U.S. PATENT DOCUMENTS 2,172,578 A 9/1939 Gladstone
2,564,933 A * 8/1951 Somerville ..... 84/411 R
6,417,432 B1 * 7/2002 Downing ..... 84/411 R
6,747,199 B2 * 6/2004 Shah ..... 84/411 R

* cited by examiner

*Primary Examiner*—Kimberly Lockett
(74) *Attorney, Agent, or Firm*—Ostrolenk, Faber, Gerb & Soffen, LLP

(57) ABSTRACT

A head diaphragm adjustor for adjusting tension applied to upper and lower head diaphragms of a drum. A first bolt adjusts the tension applied to the upper head diaphragm. A second bolt adjusts the tension applied to the lower head diaphragm. A first meshed portion and a second meshed portion are respectively meshed with the first bolt and the second bolt and fixed to the shell. The upper portion of a rod is inserted in the first bolt in a manner independently rotatable relative to the first bolt. The lower portion of the rod is connected to the second bolt in a manner slidable relative to the second bolt and rotated integrally with the second bolt. The rod includes a cylindrical portion having a diameter greater than that of the upper portion of the rod. The first bolt abuts against the cylindrical portion.

12 Claims, 5 Drawing Sheets

DRUM AND HEAD DIAPHRAGM ADJUSTOR FOR DRUM

BACKGROUND OF THE INVENTION

The present invention relates to a drum and a head diaphragm adjustor for a drum.

In the prior art, when tuning a drum, such as a bass drum or a snare drum, the drum is placed on the floor. In a state in which the surface of the drum is horizontal, the tension applied to the head diaphragm is adjusted to perform tuning. The drum is then reversed upside down to tune the reverse surface. Subsequent to the tuning, the drum is set together with a set of drums. When doing so, a holder is used to hold the tuned drum in a state tilted at a certain angle. However, the sound of the drum differs from the state in which the drum is placed horizontally on the floor and the state in which the drum is held tilted in the drum set. Thus, after setting the drum, the drum must be tuned again. In such a state, the drum is tilted and the reverse surface of the drum is difficult to reach. Thus, it is difficult to perform tuning. Further, when the reverse surface cannot be reached at all, the drum must be taken out of the drum set to tune the reverse surface, which is burdensome. Additionally, when the drum is taken out of the drum set, the sound of the drum differs slightly. Thus, the drum cannot be finely tuned.

To solve this problem, there is a known mechanism for tuning the reverse surface of the drum from the front surface in a state in which the drum is set (refer to U.S. Pat. No. 2,172,578). FIG. 6 is a cross-sectional view showing an example of such a head diaphragm adjusting mechanism for a drum.

As shown in FIG. 6, the drum includes a cylindrical shell 41 having open upper and lower ends. A disk-shaped upper head diaphragm 42 and a disk-shaped lower head diaphragm 43 cover the open ends of the shell 41. An annular upper head diaphragm frame 44, which is fitted to the outer surface of the shell 41, holds the periphery of the upper head diaphragm 42. An annular upper hoop 45, which is fitted to the outer surface of the shell 41, is arranged on the outer side of the upper head diaphragm frame 44. In the same manner, an annular lower head diaphragm frame 46, which is fitted to the outer surface of the shell 41, holds the periphery of the lower head diaphragm 43. Further, an annular lower hoop 47, which is fitted to the outer surface of the shell 41, is arranged on the outer side of the lower head diaphragm frame 46.

A head diaphragm adjusting mechanism 48 adjusts the tension applied to each head diaphragm. The head diaphragm adjusting mechanism 48 includes a pipe nut 50, which is fixed to the outer surface of the shell 41 by a lug 49, an upper adjust bolt 51, which connects the pipe nut 50 and the upper hoop 45, and a lower adjust bolt 52, which connects the pipe nut 50 and the lower hoop 47.

The upper adjust bolt 51 is a hollow pipe having a circular cross-section. The lower adjust bolt 52 is hollow and has an upper portion having a hexagonal cross-section. A polygonal head rod 53 is inserted into the upper adjust bolt 51 from above and extended to the interior of the lower adjust bolt 52. The polygonal head rod 53 is slidably engaged in the vertical direction with the lower adjust bolt 52 in the hexagonal hollow portion of the lower adjust bolt 52 so that rotation of the polygonal head rod 53 rotates the lower adjust bolt 52. At the portion where the polygonal head rod 53 is inserted into the upper adjust bolt 51, a pin 54 is inserted sideward through the upper adjust bolt 51. The pin 54 engages a stepped portion of a head of the polygonal head rod 53 so that the polygonal head rod 53 is rotatable relative to the upper adjust bolt 51 but does not fall out of the upper adjust bolt 51.

Rotation of the upper adjust bolt 51 presses the upper hoop 45 against the upper head diaphragm frame 44. This moves the upper head diaphragm frame 44 downward to adjust the tension applied to the upper head diaphragm 42. Rotation of the polygonal head rod 53, which projects out of the upper adjust bolt 51, rotates the lower adjust bolt 52. In the same manner as the upper side, this presses the lower hoop 47 against the lower head diaphragm frame 46 and moves the lower head diaphragm frame 46 upward to adjust the tension applied to the lower head diaphragm 43. In this state, although the lower adjust bolt 52 moves upward, the lower adjust bolt 52 and the lower portion of the polygonal head rod 53 are slidably engaged with each other. Further, the pin 54 fixes the upper portion of the polygonal head rod 53 so that the polygonal head rod 53 is not axially displaced. Thus, the movement of the lower adjust bolt 52 does not move the polygonal head rod 53 upwards.

Accordingly, in the prior art, the front surface and the reverse surface of the drum (corresponding to the upper head diaphragm 42 and the lower head diaphragm 43 in FIG. 6) are both tuned from the front side in a state in which the drum is set.

However, the above drum head diaphragm adjusting mechanism has a shortcoming in that the lower adjust bolt moves upward while it rotates when tuning the lower head diaphragm 43 in, for example, the direction that applies tension. This also rotates the polygonal head rod 53, which is engaged with the lower adjust bolt 52. However, when the polygonal head rod 53 does not smoothly slide along the lower adjust bolt 52 due to a misalignment or force acting in the rotation direction, axial force produced by the upward movement of the lower adjust bolt 52 is applied to the polygonal head rod 53. As a result, the pin 54, which functions to prevent the polygonal head rod 53 from falling out of the upper adjust bolt 51, receives all of the axial force. This may easily break the pin 54 and cause the polygonal head rod 53 to fall out of the upper adjust bolt 51.

SUMMARY OF THE INVENTION

Accordingly, it is an object of the present invention to provide a drum and a head diaphragm adjustor having high durability and enabling the reverse surface of the drum to be tuned from the front surface in a stable state.

To achieve the above object, the present invention provides a head diaphragm adjustor for a drum for adjusting tension applied to an upper head diaphragm and a lower head diaphragm of the drum. The head diaphragm adjustor is one of a plurality of head diaphragm adjustors attachable to an outer surface of a shell of the drum. The head diaphragm adjustor includes a first bolt operated to adjust the tension applied to the upper head diaphragm and a second bolt operated to adjust the tension applied to the lower head diaphragm. A first meshed portion is meshed with the first bolt and fixable to the outer surface of the shell of the drum. A second meshed portion is meshed with the second bolt and fixable to the outer surface of the shell of the drum. A rod includes an upper portion, a lower portion, and a cylindrical portion. The upper portion of the rod is inserted in the first bolt in a manner independently rotatable relative to the first bolt. The lower portion of the rod is connected to the second bolt in a manner slidable relative to the second bolt and rotated integrally with the second bolt. The cylindrical portion of the rod has a diameter greater than that of the upper portion of the rod. The first bolt has a lower end surface abutting against an upper end surface of the cylindrical portion.

Other aspects and advantages of the present invention will become apparent from the following description, taken in conjunction with the accompanying drawings, illustrating by way of example the principles of the invention.

BRIEF DESCRIPTION OF THE SEVERAL VIEWS OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A drum and a head-diaphragm adjustor for a drum according to a preferred embodiment of the present invention will now be discussed with reference to FIGS. 1 to 5.

Figure 1:
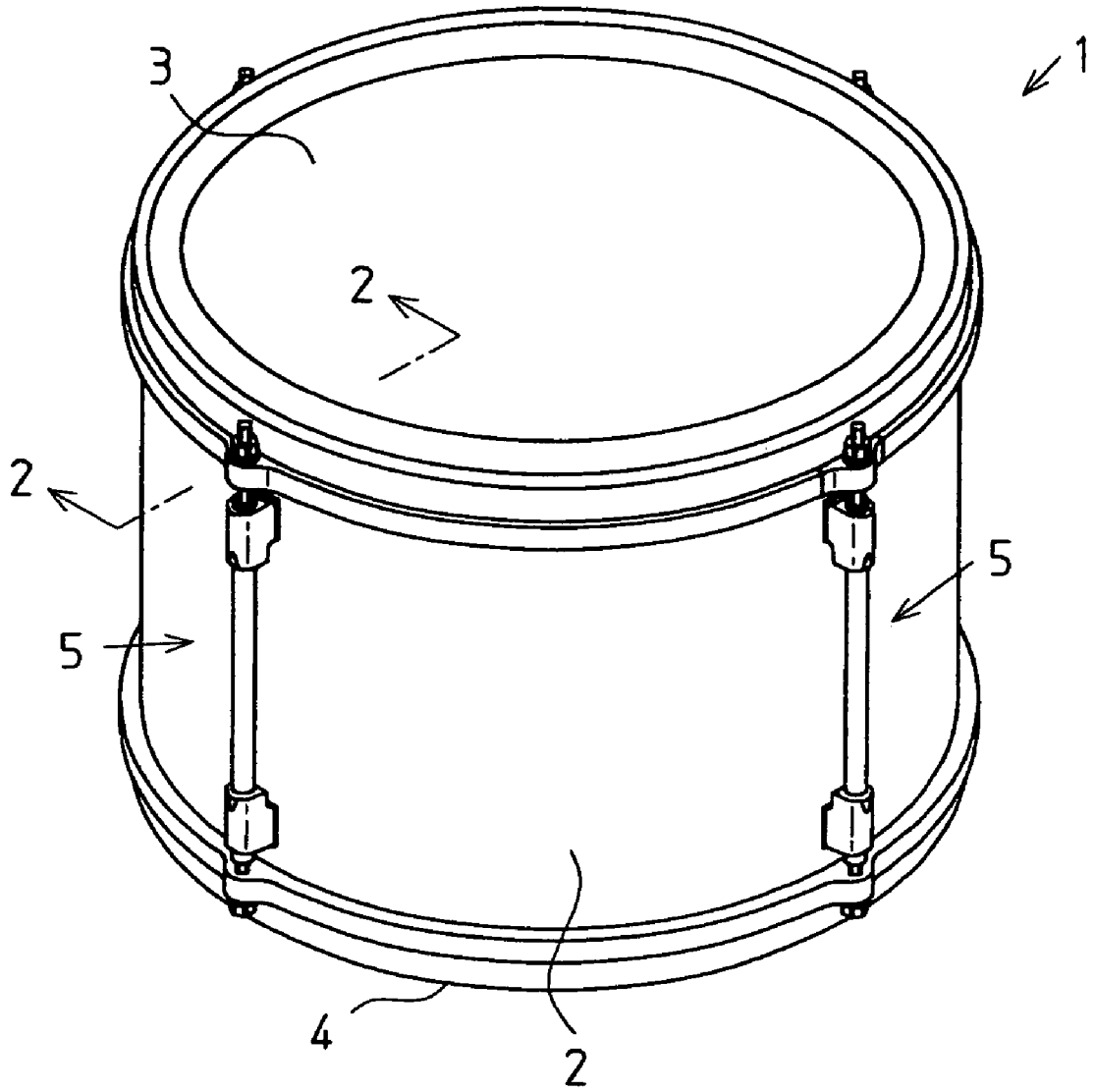
FIG. 1 is a perspective view showing a drum according to a preferred embodiment of the present invention.

Referring to FIG. 1, a drum 1 includes a cylindrical shell 2 having open upper and lower ends. A disk-shaped upper head diaphragm 3 and a disk-shaped lower head diaphragm 4 cover the open ends of the shell 2. A plurality (four in the preferred embodiment) of head diaphragm adjustors 5 are arranged along the outer surface of the shell 2 to adjust the tension applied to the upper head diaphragm 3 and the lower head diaphragm 4.

Figure 2:
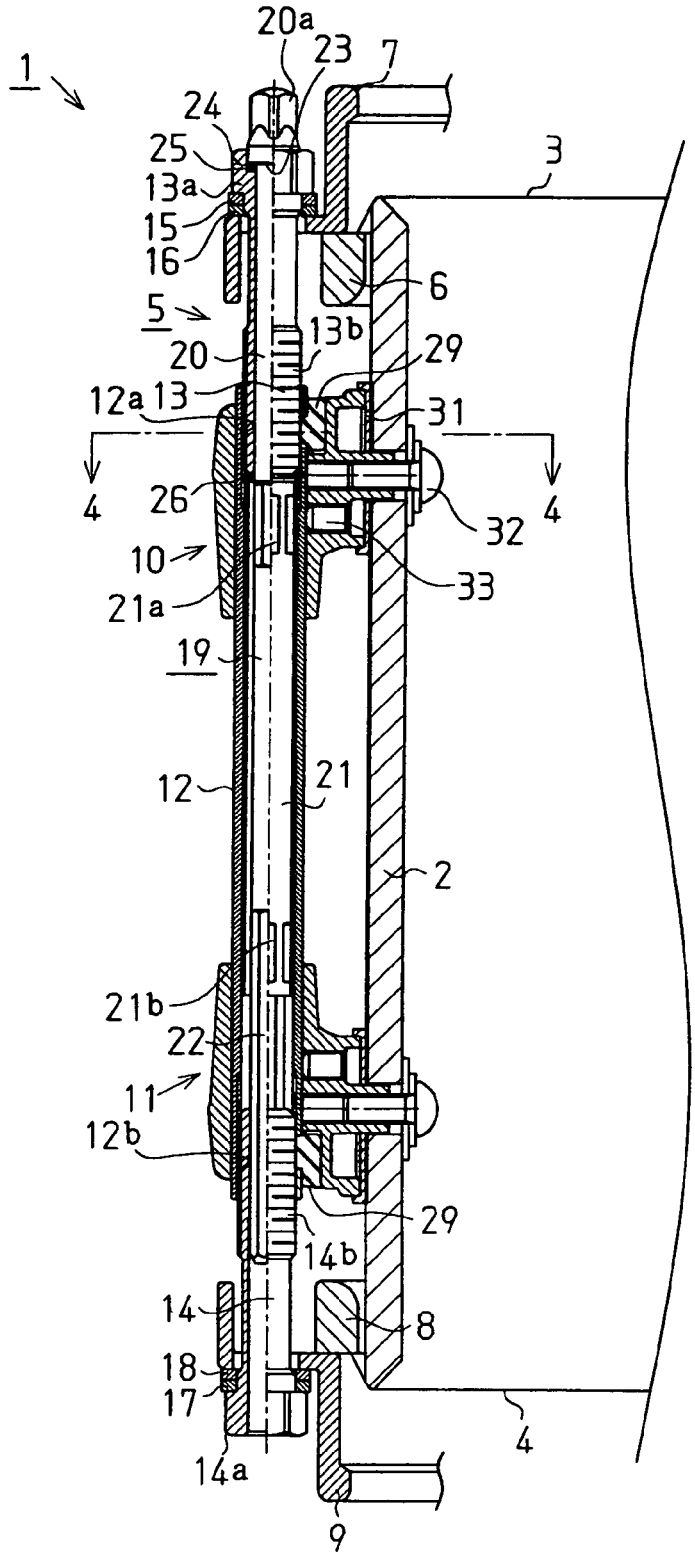
FIG. 2 is a partial cross-sectional view taken along line 2—2 in FIG. 1.

Referring to FIG. 2, an annular upper head diaphragm frame 6, which is fitted to the outer surface of the shell 2, holds the periphery of the upper head diaphragm 3. An annular upper hoop 7, which is fitted to the outer surface of the shell 2, is arranged on the outer side of the upper head diaphragm frame 6. In the same manner, an annular lower head diaphragm frame 8, which is fitted to the outer surface of the shell 2, holds the periphery of the lower head diaphragm 4. Further, an annular lower hoop 9, which is fitted to the outer surface of the shell 2, is arranged on the outer side of the lower head diaphragm frame 8.

Each head diaphragm adjustor 5 includes a pipe nut 12, which serves as a tubular member and which is fixed to the outer surface of the shell 2 by two fasteners 10 and 11, an upper adjust bolt 13, which serves as a first bolt and connects the pipe nut 12 and the upper hoop 7, and a lower adjust bolt 14, which serves as a second bolt and connects the pipe nut 12 and the lower hoop 9. The upper adjust bolt 13 and the lower adjust bolt 14 respectively have threaded distal portions 13*b* and 14*b*, which include right-hand threads. The upper adjust bolt 13 is a hollow pipe having a circular cross-section. Further, the upper adjust bolt 13 is inserted in the upper portion of the pipe nut 12 to mesh the threaded distal portion 13*b* with a female threaded portion 12*a*, which serves as a first meshed portion and which is formed on the upper inner wall of the pipe nut 12. The upper adjust bolt 13 has a head 13*a*, which functions as a rotated operation portion. Two washers 15 and 16 are arranged between the head 13*a* and the upper hoop 7.

The lower adjust bolt 14 is a hollow pipe having a hexagonal cross-section. Further, the lower adjust bolt 14 is inserted in the lower portion of the pipe nut 12 to mesh the threaded distal portion 14*b* with a female threaded portion 12*b*, which serves as a second meshed portion formed on the lower inner wall of the pipe nut 12. The lower adjust bolt 14 has a head 14*a*, which functions as a rotated operation portion. Two washers 17 and 18 are arranged between the head 14*a* and the lower hoop 9. A rod 19 is inserted in the upper adjust bolt 13 from above and extended to the interior of the lower adjust bolt 14.

Figure 3:
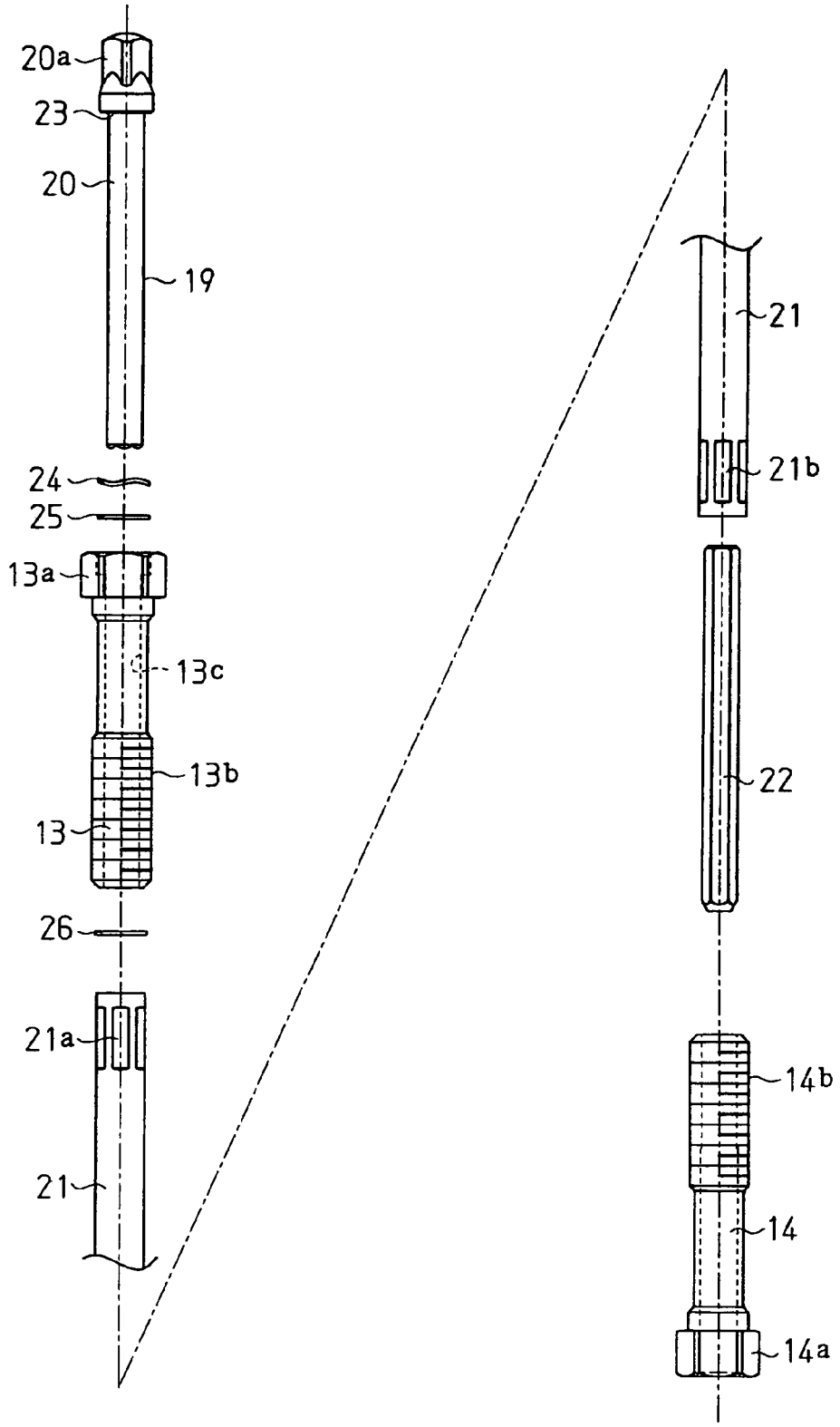
FIG. 3 is an exploded view showing an upper adjust bolt, a rod, and a lower adjust bolt.

FIG. 3 is an exploded view showing the upper adjust bolt 13, the rod 19, and the lower adjust bolt 14. The rod 19 is an assembly in which a polygonal head rod 20 serving as an upper rod, an extension pipe 21 serving as a cylindrical portion, and a hexagonal rod 22 serving as a lower rod are arranged from above in this order. As shown in FIG. 3, the polygonal head rod 20 is inserted in the upper adjust bolt 13. A lower end portion of the polygonal head rod 20 extending downward from the upper adjust bolt 13 is inserted in the extension pipe 21 and externally clamped at a tightening portion 21*a*. This fixes the polygonal head rod 20 to the extension pipe 21 (refer to FIG. 2).

An upper end portion of the hexagonal rod 22 is inserted in the extension pipe 21 and externally clamped at a tightening portion 21*b*. This fixes the polygonal head rod 20 to the extension pipe 21. Further, the polygonal head rod 20 has a polygonal head 20*a*, which is inserted through and extended out of the upper adjust bolt 13. A bore 13*c* having a round cross-section extends through the upper adjust bolt 13. Due to the bore 13*c*, the polygonal head rod 20 is independently rotatable relative to the upper adjust bolt 13. A wave washer 24 and a small washer 25 are arranged between a lower end surface 23 of the polygonal head 20*a* and an upper end surface of the upper adjust bolt 13, which faces toward the lower end surface 23 (refer to FIG. 2). A further small washer 26 is arranged between a lower end surface of the upper adjust bolt 13 and an upper end surface of the extension pipe 21 (refer to FIG. 2).

The hexagonal rod 22 has a lower end portion inserted in a hexagonal hole extending through the lower adjust bolt 14. The hexagonal hole has a cross-section that substantially corresponds to the hexagonal rod 22. A slight gap is formed between the lower end portion of the hexagonal rod 22 and the wall of the hexagonal hole to restrict relative rotation between the hexagonal rod 22 and the lower adjust bolt 14. Thus, the hexagonal rod 22 is vertically slidable relative to the lower adjust bolt 14 and integrally rotated with the lower adjust bolt 14 (refer to FIG. 2).

Figure 4:
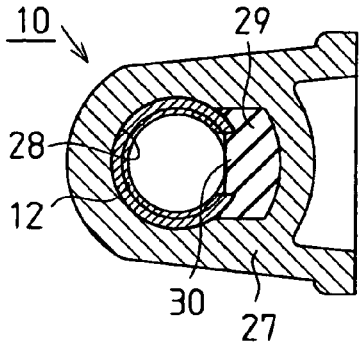
FIG. 4 is an enlarged cross-sectional view taken along line 4—4 in FIG. 2 and showing an upper fastener.

The fasteners 10 and 11 shown in FIG. 2 have the same structure and are arranged near the upper end and the lower end of the pipe nut 12. Thus, only the fastener 10 will be described in detail. FIG. 4 shows a state in which the fastener 10 is fixed to the outer surface of the pipe nut 12 but does not show parts such as the rod 19 inserted in the pipe nut 12.

As shown in FIG. 4, the fastener 10 includes a lug 27, which includes an insertion hole 28 with a diameter that is substantially the same as the diameter of the pipe nut 12. The lug 27 includes a stopper 29, which has a projection 30. The projection 30 extends through the outer wall of the pipe nut 12 and projects into the interior of the pipe nut 12. The stopper 29 is an elastic body made of, for example rubber or a synthetic resin. Thus, when the upper adjust bolt 13 is inserted in the pipe nut 12, which is received in the insertion hole 28, the projection 30 of the stopper 29 presses the outer surface of the upper adjust bolt 13 against the inner surface of the pipe nut 12. The fastener 10 includes a screw 33, as shown in FIG. 2. The screw 33 fastens the pipe nut 12 to the fastener 10. The fastener 10 has a basal end that is fixed to the outer surface of the shell 2 of the drum 1 by a screw 32 with a spacer 31 arranged between the fastener 10 and the shell 2.

The lower fastener 11, which is arranged near the lower end of the pipe nut 12, has the same structure as the upper fastener 10. Therefore, in the lower fastener 11, the stopper 29 presses the outer surface of the lower adjust bolt 14 against the inner surface of the pipe nut 12. In this state, the fastener 11 is attached to the outer surface of the shell 2 in the same manner as the fastener 10.

The procedures for adjusting the tension applied to the head diaphragms 3 and 4 with the head diaphragm adjustor 5 and the operation of the head diaphragm adjustor 5 will now be discussed.

When adjusting the tension applied to the upper head diaphragm 3, a predetermined tool is used to rotate the head 13*a* of the upper adjust bolt 13. For example, when tuning the upper head diaphragm 3 in a direction that applies tension, the head 13*a* of the upper adjust bolt 13 is rotated rightwards to increase the meshed portion of the upper adjust bolt 13 and the pipe nut 12. This lowers the upper adjust bolt 13 in accordance with its rotated amount. As a result, the head 13*a* of the upper adjust bolt 13 pushes the upper hoop 7 downward. Then, the upper hoop 7 pushes and moves the upper head diaphragm frame 6 downwards. Accordingly, the peripheral portion of the upper head diaphragm 3, which is held by the upper head diaphragm frame 6, is pulled downwards to adjust tension in the tension applying direction.

As the upper adjust bolt 13 moves downward while it rotates, the rod 19 (i.e., polygonal head rod 20, extension pipe 21, and hexagonal rod 22) also moves downward. However, since the polygonal head rod 20 is rotatable independently from the upper adjust bolt 13, the polygonal head rod 20 does not follow the rotation of the upper adjust bolt 13. Thus, the polygonal head rod 20 only moves downward in cooperation with the upper adjust bolt 13 and does not rotate.

The hexagonal rod 22, which forms part of the rod 19, slides downward along the inner surface of the lower adjust bolt 14 but does not rotate. Accordingly, the rotation of the upper adjust bolt 13 does not affect the lower adjust bolt 14. Further, the stopper 29 of the fastener 11 restricts rotation of the lower adjust bolt 14. Thus, the lower adjust bolt 14 restricts rotation of the rod 19 when the upper adjust bolt 13 is rotated.

When the upper head diaphragm 3 is tuned in a direction that loosens tension, the head 13*a* of the upper adjust bolt 13 is rotated leftwards to loosen the tension applied to the upper head diaphragm 3. The leftward rotation of the head 13*a* of the upper adjust bolt 13 decreases the meshed portion of the upper adjust bolt 13 and the pipe nut 12 and moves the upper adjust bolt 13 upwards. This gradually decreases the downward force applied to the upper hoop 7 and moves the upper head diaphragm frame 6 upward in a manner that is reversed from when applying tension to the upper head diaphragm 3. Accordingly, the upper head diaphragm 3 is adjusted in a tension loosening direction.

A predetermined tool is used to rotate the polygonal head 20*a* of the polygonal head rod 20 to adjust the tension applied to the lower head diaphragm 4. Rotation of the polygonal head 20*a* integrally rotates the extension pipe 21 and the hexagonal rod 22 of the rod 19. This also rotates the lower adjust bolt 14, which is fitted to the hexagonal rod 22.

For example, when tuning the lower head diaphragm 4 in the tension applying direction, the polygonal head rod 20 is rotated leftwards. This rotates the lower adjust bolt 14 rightwards (rightward as viewed from the lower side in FIG. 2 or clockwise when viewing only the bolt) and increases the meshed portion of the lower adjust bolt 14 and the pipe nut 12. As a result, the lower adjust bolt 14 is lifted in accordance with its rotated amount. Further, the head 14*a* of the lower adjust bolt 14 pulls the lower hoop 9 upward. Then, the lower hoop 9 pushes and moves the lower head diaphragm frame 8 upwards. Accordingly, the lower head diaphragm 4, which is held by the lower head diaphragm frame 8, is pushed upwards to adjust tension in the tension applying direction.

As the lower adjust bolt 14 moves upward while it rotates, the rod 19 (i.e., polygonal head rod 20, extension pipe 21, and hexagonal rod 22), which is fitted to the lower adjust bolt 14, receives axial load acting in the upward direction due to misalignment or force applied in the rotation direction. The axial load is received by the lower end surface of the upper adjust bolt 13, which abuts against the upper end surface of the extension pipe 21 by way of the small washer 26.

When the lower head diaphragm 4 is tuned in a direction that loosens tension, the polygonal head 20*a* of the polygonal head rod 20 is rotated rightwards so that the head 14*a* of the lower adjust bolt 14 is rotated leftwards (leftward as viewed from the lower side in FIG. 2 or counterclockwise when viewing only the bolt). This loosens the tension applied to the lower head diaphragm 4 in a manner reversed from when applying tension to the lower head diaphragm 4.

In the preferred embodiment, the lower adjust bolt 14 having the right hand threads is arranged so that its head 14*a* is located at the lower side. Thus, when the polygonal head rod 20 is rotated leftward from above, the tension applied to the lower head diaphragm 4 is gradually increased. When the polygonal head rod 20 is rotated rightward, the tension applied to the lower head diaphragm 4 is gradually decreased.

After setting the drum 1 in the drum set, the tension applied to the lower head diaphragm 4 is adjusted from the front side. Thus, in the above description, the polygonal head 20*a* of the polygonal head rod 20 is operated from the top side. However, before setting the drum 1 in the drum set, the drum 1 may be placed on the floor to directly operate the head 14*a* of the lower adjust bolt 14 and adjust the tension applied to the lower head diaphragm 4.

The preferred embodiment has the advantages described below.

(1) In the preferred embodiment, the rod 19 is an assembly including the polygonal head rod 20, the extension pipe 21, and the hexagonal rod 22. Further, the upper portion of the rod 19 is inserted in the upper adjust bolt 13 in a manner that the rod 19 is independently rotatable relative to the upper adjust bolt 13. The lower portion of the rod 19 is connected to the lower adjust bolt 14 in a manner that the rod 19 is slidable relative to the lower adjust bolt 14 and integrally rotated with the lower adjust bolt 14. Thus, when the polygonal head 20*a* of the polygonal head rod 20 is rotated, the rotation is transmitted to the lower adjust bolt 14. This adjusts the tension applied to the lower head diaphragm 4 from the front side of the drum 1. Accordingly, before setting the drum 1 in the drum set, the head 13*a* of the upper adjust bolt 13 and the head 14*a* of the lower adjust bolt 14 are directly operated to tune the head diaphragms 3 and 4. When finely adjusting the tension applied to the lower head diaphragm 4 after setting the drum 1 in the drum set, the polygonal head 20*a* of the polygonal head rod 20 is operated to re-adjust the lower head diaphragm 4 from the top side of the drum 1.

Figure 6:
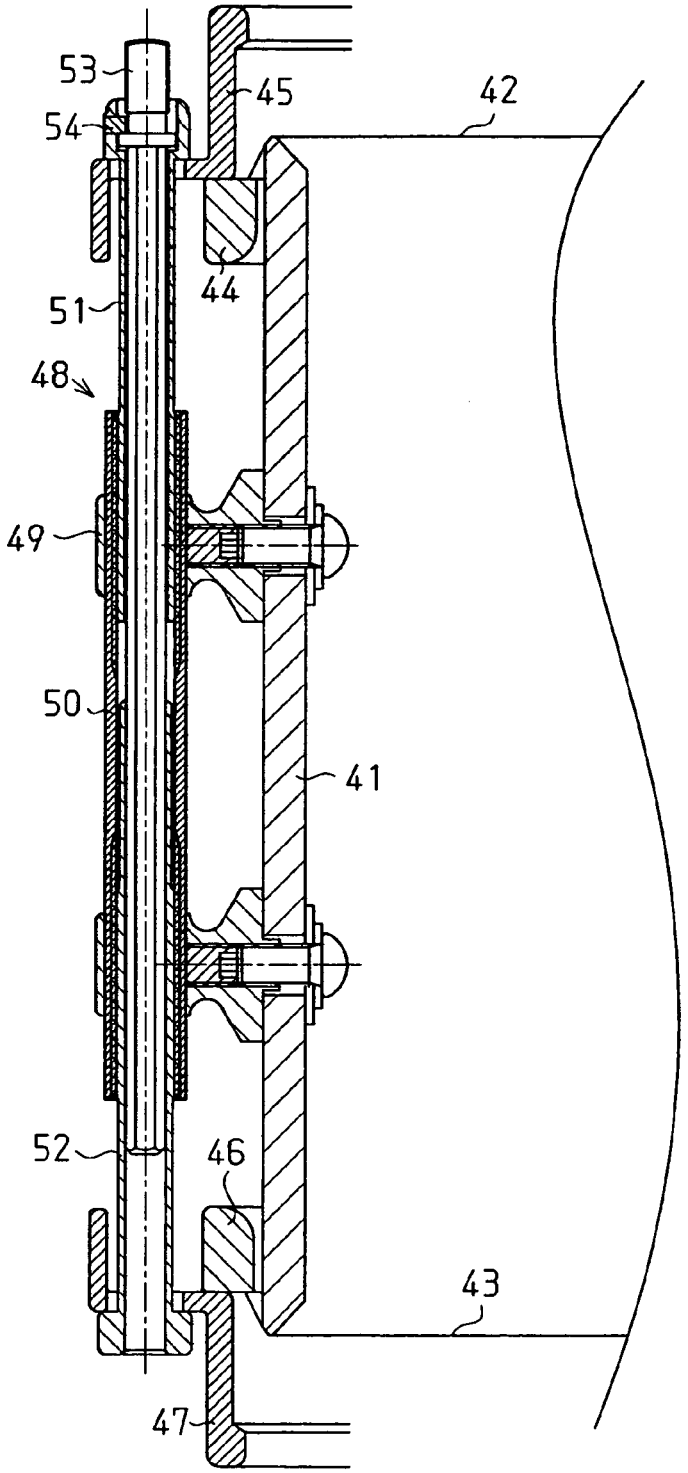
Fig.6 (Prior Art)
FIG. 6 is a cross-sectional view showing a prior art head diaphragm adjusting mechanism.

(2) In the preferred embodiment, the polygonal head rod 20 is inserted in the extension pipe 21 and externally clamped. Further, the lower end surface of the upper adjust bolt 13 abuts against the upper end surface of the extension pipe 21 by way of the small washer 26. This determines the position of the polygonal head rod 20 relative to the upper adjust bolt 13. Further, axial load, which is produced by friction or misalignment of the rotating axis when the lower adjust bolt 14 moves upward as it rotates, is received by the lower end surface of the upper adjust bolt 13. In comparison to, for example, the structure of the prior art shown in FIG. 6 in which the axial load is received at a single point (i.e., the pin 54 in FIG. 6), the strength resisting axial load is increased and the durability is improved.

The extension pipe 21 of the rod 19 has a diameter that is greater than the hexagonal rod 22, which is arranged at the lower portion of the extension pipe 21. In comparison with when using a single rod as in the prior art, this increases rigidity and decreases torsion acting about the rotating axis. Thus, even in a structure in which the extension pipe 21 is elongated such as in a floor tom-tom drum or a bass drum, the torque applied to the polygonal head 20*a* of the polygonal head rod 20 is efficiently transmitted to the lower adjust bolt 14. This increases durability and enables an adjustment feel perceivable through the polygonal head 20*a*.

Further, the extension pipe 21 functions as a positioning means for the upper adjust bolt 13 of the polygonal head rod 20 and a means for receiving upward load. Thus, other components are unnecessary, the number of components is small, and manufacturing is facilitated.

(3) In the above embodiment, the rod 19 is an assembly including the polygonal head rod 20, the extension pipe 21, and the hexagonal rod 22. Thus, by changing the length of the extension pipe 21, a head diaphragm adjustor applicable to various types of drums having different sizes (heights) may be produced.

(4) In the preferred embodiment, the small washer 26 is arranged between the lower end surface of the upper adjust bolt 13 and the upper end surface of the extension pipe 21. This smooths the rotation of the upper adjust bolt 13 and enables tuning with small force.

(5) In the preferred embodiment, the wave washer 24 is arranged between the lower end surface 23 of the polygonal head 20*a* of the polygonal head rod 20 and the upper end surface of the upper adjust bolt 13, which faces toward the lower end surface 23. This prevents the polygonal head rod 20 from being loosened and prevents noise from being produced during rotation.

(6) In the preferred embodiment, the stopper 29, which functions as an elastic member, of each of the fasteners 10 and 11 includes the projection 30, which extends through the outer wall of the pipe nut 12 and into the interior of the pipe nut 12. The projection 30 presses the outer surface of the corresponding adjust bolt 13 or 14 and fixes the adjust bolt 13 or 14. This prevents loosening of the adjust bolts 13 and 14. Further, the rotation of the upper adjust bolt 13 is prevented even when the polygonal head 20*a* of the polygonal head rod 20 is rotated. This facilitates the adjustment of the tension applied to the lower head diaphragm 4 by the polygonal head 20*a*.

Further, the stopper 29 has a positioning function when assembling together the fasteners 10 and 11 and the pipe nut 12. This facilitates the assembling.

It should be apparent to those skilled in the art that the present invention may be embodied in many other specific forms without departing from the spirit or scope of the invention. Particularly, it should be understood that the present invention may be embodied in the following forms.

In the preferred embodiment, the lower adjust bolt 14 uses right hand threads. However, left hand threads may be used instead. In this case, rightward rotation of the polygonal head 20*a* of the polygonal head rod 20 gradually increases the tension applied to the lower head diaphragm 4, and leftward rotation of the polygonal head 20*a* gradually decreases the tension applied to the lower head diaphragm 4.

In the preferred embodiment, the pipe nut 12 is tubular to accommodate the extension pipe 21. Instead, two independent pipe nuts covering only the portions of the pipe nut 12 where the fasteners 10 and 11 are fixed may be used.

Figure 5:
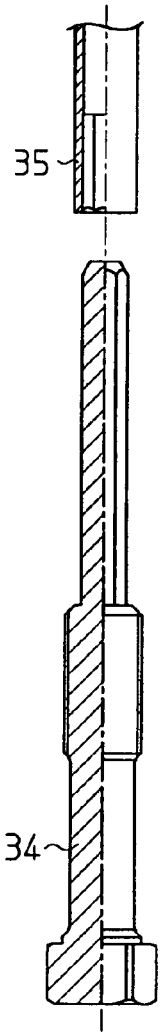
FIG. 5 is a schematic diagram showing an extension pipe and a lower adjust bolt in a further embodiment of the present invention.

In the preferred embodiment, the hexagonal rod 22 and the lower adjust bolt 14 are separate parts. Instead, the hexagonal rod 22 and the lower adjust bolt 14 may be integrally formed with each other into a single part, as shown in FIG. 5. In this case, an extension pipe 35 having a lower portion with a hexagonal cross-section is fitted to a lower adjust bolt 34 with which a polygonal head rod is formed integrally. Such a structure would have the same advantages as the preferred embodiment.

In the preferred embodiment, the wave washer 24 is arranged between the lower end surface 23 of the polygonal head 20*a* of the polygonal head rod 20 and the upper end surface of the upper adjust bolt 13, which faces toward the lower end surface 23. In lieu of the wave washer 24, an elastic element, such as a spring washer or a Belleville spring may be used. Such a structure would have the same advantages as the wave washer 24.

The present examples and embodiments are to be considered as illustrative and not restrictive, and the invention is not to be limited to the details given herein, but may be modified within the scope and equivalence of the appended claims.

What is claimed is:

1. A head diaphragm adjustor for a drum for adjusting tension applied to an upper head diaphragm and a lower head diaphragm of the drum, wherein the head diaphragm adjustor is one of a plurality of head diaphragm adjustors attachable to an outer surface of a shell of the drum, the head diaphragm adjustor comprising:

a first bolt operated to adjust the tension applied to the upper head diaphragm;

a second bolt operated to adjust the tension applied to the lower head diaphragm;

a first meshed portion meshed with the first bolt and fixable to the outer surface of the shell of the drum;

a second meshed portion meshed with the second bolt and fixable to the outer surface of the shell of the drum;

a rod including an upper portion, a lower portion, and a cylindrical portion, the upper portion of the rod being inserted in the first bolt in a manner independently rotatable relative to the first bolt, the lower portion of the rod being connected to the second bolt in a manner slidable relative to the second bolt and rotated integrally with the second bolt, and the cylindrical portion of the rod having a diameter greater than that of the upper portion of the rod, the first bolt having a lower end surface abutting against an upper end surface of the cylindrical portion.

2. The head diaphragm adjustor according to claim 1, wherein the rod includes:

an upper rod;

a pipe connected to the upper rod and functioning as the cylindrical portion; and a lower rod connected to the pipe, wherein the upper rod has a lower end portion extending through the first bolt and inserted in the pipe, and the lower rod is fitted to the second bolt and has an upper end portion inserted in the pipe.

3. The head diaphragm adjustor according to claim 2, wherein the lower end surface of the first bolt and the upper end surface of the pipe abut against each other by way of a washer.

4. The head diaphragm adjustor according to claim 2, wherein the upper rod has a head having a diameter greater than that at a portion lower than the head, and a washer formed by an elastic member is arranged between a lower end surface of the head and an upper end surface of the first bolt.

5. The head diaphragm adjustor according to claim 2, further comprising:

a tubular member having an upper portion that includes the first meshed portion and a lower portion that includes the second meshed portion;

a fastener fixed to an outer surface of the tubular member to fasten the tubular member to the shell of the drum, the fastener including a stopper extending through a wall of the tubular member and projecting into the tubular member to abut against an outer surface of at least one of the first bolt and the second bolt.

6. The head diaphragm adjustor according to claim 5, wherein the stopper is an elastic member.

7. A drum comprising a shell, an upper head diaphragm, a lower head diaphragm, and an adjustor for adjusting tension applied to both head diaphragms, the adjustor including:

a first bolt operated to adjust the tension applied to the upper head diaphragm;

a second bolt operated to adjust the tension applied to the lower head diaphragm;

a first meshed portion meshed with the first bolt and fixed to the outer surface of the shell of the drum;

a second meshed portion meshed with the second bolt and fixed to the outer surface of the shell of the drum;

a rod including an upper portion, a lower portion and a cylindrical portion, the upper portion of the rod being inserted in the first bolt in a manner independently rotatable relative to the first bolt, the lower portion of the rod being connected to the second bolt in a manner slidable relative to the second bolt and rotated integrally with the second bolt, and the cylindrical portion of the rod having a diameter greater than that of the upper portion of the rod, the first bolt having a lower end surface abutting against an upper end surface of the cylindrical portion.

8. The drum according to claim 7, wherein the rod includes:

an upper rod;

a pipe connected to the upper rod and functioning as the cylindrical portion; and a lower rod connected to the pipe, wherein the upper rod has a lower end portion extending through the first bolt and inserted in the pipe, and the lower rod is fitted into the second bolt and has an upper end portion inserted in the pipe.

9. The drum according to claim 8, wherein the lower end surface of the first bolt and the upper end surface of the pipe abut against each other by way of a washer.

10. The drum according to claim 8, wherein the upper rod has a head having a diameter greater than that at a portion lower than the head, and a washer formed by an elastic member is arranged between a lower end surface of the head and an upper end surface of the first bolt.

11. The drum according to claim 8, further comprising:

a tubular member having an upper portion that includes the first meshed portion and a lower portion that includes the second meshed portion;

a fastener fixed to an outer surface of the tubular member to fasten the tubular member to the shell of the drum, the fastener including a stopper extending through a wall of the tubular member and projecting into the tubular member to abut against an outer surface of at least one of the first bolt and the second bolt.

12. The drum according to claim 11, wherein the stopper is an elastic member.

* * * * *